US008347644B2

(12) United States Patent
Liu et al.

(10) Patent No.: US 8,347,644 B2
(45) Date of Patent: Jan. 8, 2013

(54) AIR CONDITIONING SYSTEM

(75) Inventors: Chung-Che Liu, Hsinchu (TW); Ling-Yu Chao, Taichung (TW); Hsu-Cheng Chiang, Hsinchu (TW); Chia-Hung Liu, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 665 days.

(21) Appl. No.: 12/571,985

(22) Filed: Oct. 1, 2009

(65) Prior Publication Data

US 2010/0229587 A1 Sep. 16, 2010

(30) Foreign Application Priority Data

Mar. 13, 2009 (TW) ..... 98108335 A

(51) Int. Cl.

| | |
|---|---|
| ***F25B 13/00*** | (2006.01) |
| ***F25B 5/00*** | (2006.01) |
| ***F25B 43/00*** | (2006.01) |
| ***F25B 41/00*** | (2006.01) |

(52) U.S. Cl. ..... 62/199; 62/160; 62/512; 62/513

(58) Field of Classification Search ..... 62/199, 62/335, 332, 333, 119, 512, 159, 160, 513; 165/128, 108, 120, 121, 123, 104.13, 104.21, 165/104.34

See application file for complete search history.

(56) References Cited

U.S. PATENT DOCUMENTS

| | | | | |
|---|---|---|---|---|
| 4,843,832 | A * | 7/1989 | Yamada et al. | 62/159 |
| 5,105,845 | A * | 4/1992 | Rorex, Sr. | 137/256 |
| 7,451,611 | B2 * | 11/2008 | Muscatell | 62/235.1 |

FOREIGN PATENT DOCUMENTS

| | | | |
|---|---|---|---|
| CN | 1168962 | A | 12/1997 |
| CN | 1403747 | A | 3/2003 |
| CN | 1738727 | A | 2/2006 |
| CN | 101067505 | A | 11/2007 |
| CN | 101278105 | A | 10/2008 |
| JP | 2000-179898 | A | 6/2000 |
| JP | 2001289465 | A | 10/2001 |
| JP | 2002-106995 | A | 4/2002 |
| JP | 2003336918 | A * | 11/2003 |
| TW | 12982811 | | 1/2008 |
| TW | I292811 | | 1/2008 |

OTHER PUBLICATIONS

SIPO Office Action dated Aug. 27, 2012.

* cited by examiner

*Primary Examiner* — Judy Swann
*Assistant Examiner* — Jon T Schermerhorn
(74) *Attorney, Agent, or Firm* — Morris Manning & Martin LLP; Tim Tingkang Xia, Esq.

(57) ABSTRACT

An air conditioning system includes a first circulation module and a second circulation module. Two circulation modules are joined by a heat exchanger. The first circulation is a modular refrigeration system includes a compressor, expansion device, and heat exchangers. The second circulation module includes a main liquid refrigerant tank, a number of distributed liquid refrigerant tanks, liquid pumps and a plurality of indoor units which includes a heat exchange device and a vapor propelling device. The heat exchange device is connected to the main liquid tank. The vapor propelling device propels the working fluid in a saturated vapor state to the first heat exchanger, thus forming a working fluid loop. It can be switched between the heating and cooling modes.

14 Claims, 7 Drawing Sheets

AIR CONDITIONING SYSTEM

CROSS-REFERENCE TO RELATED APPLICATIONS

This non-provisional application claims priority under 35 U.S.C. §119(a) on Patent Application No(s). 098108335 filed in Taiwan, R.O.C. on Mar. 13, 2009, the entire contents of which are hereby incorporated by reference.

BACKGROUND OF THE INVENTION

1. Field of Invention

The present invention relates to an air conditioning system, and more particularly to an air conditioning system capable of adjusting temperature through a secondary circulation.

2. Related Art

Variable Refrigerant Volume (VRV) also known as Variable refrigerant flow (VRF) consists of a number of air handling units connected to a modular external condensing unit, and allows refrigerant flow to be varied using either an inverter controlled variable speed compressor, or multiple compressors of varying capacity in response to changes in the cooling or heating requirements within the air conditioned space. A sophisticated control system enables switching between the heating and cooling modes. This type of system requires no internal plant room space and offers great flexibility through the many types of air handling units available. Applications vary from office, retail, hotel, luxury apartments, industrial, new and retrofitted buildings.

However, as the outdoor unit and the indoor units of the conventional VRV air conditioning system belong to the same circulation, i.e., the outdoor unit and the indoor units are all located in the same refrigerant circulation loop, the conventional VRV air conditioning system has the following problems in operation.

Generally, in order to make the compressor operate normally, in the prior art, a lubricant is used to lubricate the compressor. As the lubricant applied to the compressor usually exists in an oil tank of the compressor or in the refrigerant circulation system in a liquid state, and the refrigerant returning to the compressor after passing through the evaporator is usually in a vapor state. When the compressor is in operation, a part of the lubricant is usually discharged from the compressor with the refrigerant. As the outdoor unit and the indoor units of the conventional VRV air conditioning system all belong to the same circulation, the lubricant carried out of the compressor flows in the circulation refrigeration system with the refrigerant.

To solve the above problem, in the prior art, a device is added to the refrigeration system for retaining lubricant (for example, a high-efficiency oil separator is mounted at the outlet of the refrigerant on the compressor, so as to intercept the lubricant and prevent the lubricant from being carried out of the compressor with the vaporous refrigerant), or a more complicated control method is employed (for example, the running speed of the compressor is increased under a low load and at a specific time to accelerate the flow of the refrigerant, thus providing adequate vapor velocity to assure oil return), such that the lubricant flows back to the compressor. However, such a design makes the system more complicated.

The aforementioned refrigerating circulation is generally used in a large building, and thus the compressor is placed above the evaporator by 30 meters or even higher. When the height difference between the evaporator and the compressor is too big or the compressor is unloaded due to lower cooling demands from the air conditioned object, the vaporous refrigerant may not carry the lubricant any longer due to insufficient velocity of vapor flowing through the suction line, so that the lubricant is accumulated within the refrigerating tubes and the pipes and progressive loss of oil from the compressor. Insufficient oil is left to properly lubricate and cool the compressor, thereby causing the compressor to fail. As a result, a vertical restraint of the piping design in the prior art appears.

Similarly, when the horizontal length of the pipe is too long, the vaporous refrigerant may not carry the lubricant any longer due to insufficient velocity of vapor flowing through the suction line, so that the lubricant is easily accumulated within the refrigerating tubes and pipes. As a result, a horizontal restraint of the piping design in the prior art appears.

SUMMARY OF THE INVENTION

Accordingly, the present invention is directed to an air conditioning system capable of adjusting a temperature through a secondary circulation, so as to solve the problem in the prior art that the lubricant is carried out of the compressor and retained in the big refrigeration system and thus cannot return to the compressor.

An air conditioning system comprising a first circulation module and a second circulation module is provided. A first working fluid and a second working fluid are respectively circulated in the first circulation module and the second circulation module. The first circulation module comprises a compressor, a first heat exchanger, an expansion device, and a second heat exchanger. The compressor is used for compressing the first working fluid from a low-pressure vapor state to a high-pressure vapor state. The first heat exchanger is connected to the compressor. The expansion device is connected to the first heat exchanger. The second heat exchanger is connected between the expansion device and the compressor. The second circulation module comprises multiple third heat exchangers. Each of the third heat exchangers comprises a heat exchange device and a vapor propelling device. The heat exchange device has a first end and a second end. The vapor propelling device is communicated between the first end and the third heat exchanger, and the second end is connected to the third heat exchanger, to form a working fluid loop between the fourth heat exchanger and the third heat exchangers. The vapor propelling device propels the second working fluid in a saturated vapor state to flow between the heat exchange device and the second heat exchanger, wherein in the second heat exchanger, heat exchange is performed between the second working fluid and the first working fluid.

According to a preferred embodiment of the present invention, the air conditioning system further comprises a main liquid storage tank connected between the third heat exchanger and the second end. Preferably, the main liquid storage tank is placed higher than the fourth heat exchangers.

According to a preferred embodiment of the present invention, in addition to the main liquid storage tank, the air conditioning system further comprises a pump and a control device. The pump is placed lower than the second end of the heat exchange devices, and is communicated with the main liquid storage tank. The control device is communicated between the main liquid storage tank, the second end, and the pump, and has a first status and a second status. In the first status, the control device guides the second working fluid into the second end; in the second status, the control device guides the second working fluid into the pump. Preferably, the control device is a valve placed at a height between the second end and the pump.

According to a preferred embodiment of the present invention, in addition to the pump and the control device, the air conditioning system further comprises a fourth heat exchanger and a control device module. The fourth heat exchanger is located in the main liquid storage tank. The control device module is communicated between the expansion device, the second heat exchanger, and the fourth heat exchanger, and has a first status and a second status. In the first status, the control device module guides the second working fluid into the second heat exchanger; in the second status, the control device module guides the second working fluid into the fourth heat exchanger. Preferably, the control device module comprises a first valve and a second valve. The first valve is located in a first flow path extending from the expansion device to the main liquid storage tank through the second heat exchanger. The second valve is located in another flow path extending from the expansion device to the main liquid storage tank without passing through the second heat exchanger.

According to a preferred embodiment of the present invention, in addition to the pump and the control device, the air conditioning system further comprises a liquid-vapor separation tank. An upper side of the liquid-vapor separation tank is communicated with the vapor propelling device and the main liquid storage tank, and a lower side of the liquid-vapor separation tank is communicated with the control device. Preferably, a secondary liquid storage tank is communicated between the valve and the pump. Preferably, the air conditioning system further comprises a liquid level sensor located in the liquid-vapor separation tank, for measuring a liquid level of the second working fluid in the liquid-vapor separation tank.

According to a preferred embodiment of the present invention, in addition to the pump and the control device, each of the fourth heat exchangers further comprises a valve communicated between the main liquid storage tank and the heat exchange device.

According to a preferred embodiment of the present invention, the vapor propelling device is a fan or a blower.

According to a preferred embodiment of the present invention, the fourth heat exchangers are located below the first circulation module.

According to a preferred embodiment of the present invention, the air conditioning system further comprises a pump located between the main liquid storage tank and the fourth heat exchangers.

According to a preferred embodiment of the present invention, the second circulation module of the air conditioning system does not comprise a compressor.

In view of the above, as the present invention adopts a first circulation module and a second circulation module independent from each other, and the second circulation module does not have a compressor for compressing the working fluid from a low-pressure vapor state to a high-pressure vapor state, the problem that the lubricant is retained in the circulation refrigeration system may not occur in the second circulation module.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1:
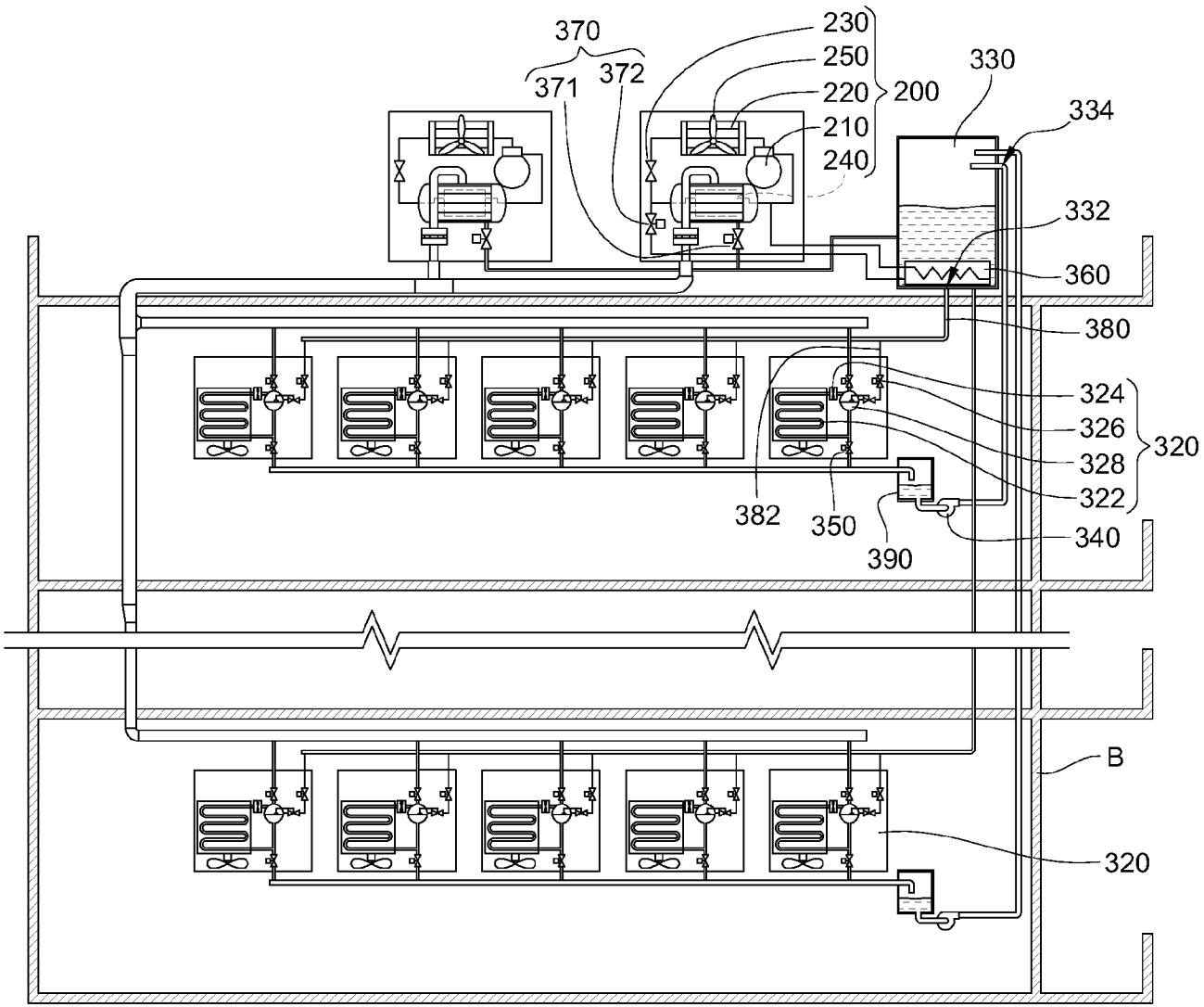
FIG. 1 is a schematic view of an air conditioning system according to an embodiment of the present invention.
Figure 2:
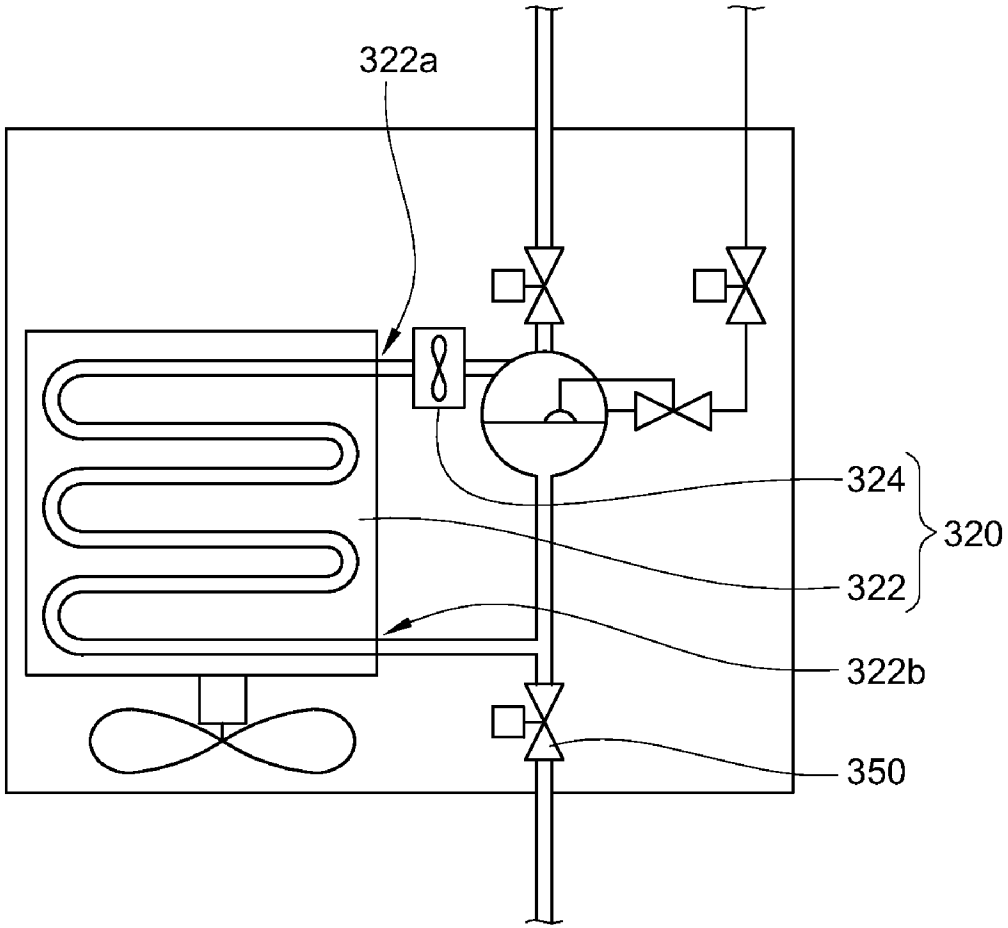
FIG. 2 is a schematic enlarged view of a fourth heat exchanger in FIG. 1.

FIG. 1 is a schematic view of an air conditioning system according to an embodiment of the present invention. FIG. 2 is a schematic enlarged view of a third heat exchanger 320 in FIG. 1. Referring to FIGS. 1 and 2 together, the air conditioning system 100 comprises a first circulation module 200 and a second circulation module. The first circulation module 200 comprises a compressor 210, a first heat exchanger 220, an expansion device 230, and a second heat exchanger 240. The first heat exchanger 220 is connected to the compressor 210. The expansion device 230 is connected to the first heat exchanger 220. The second heat exchanger 240 is connected between the expansion device 230 and the compressor 210. A first working fluid R1 (not shown) is circulated between the compressor 210, the first heat exchanger 220, the expansion device 230, and the second heat exchanger 240. The first working fluid R1 is R-134a, R-12, R-22, or other types of refrigerants. The number of the first circulation module 200 is not limited herein. In this embodiment, as shown in FIG. 1, the air conditioning system 100 may comprise multiple first circulation modules 200 connected in parallel to enhance the cooling capability of the air conditioning system 100.

The second circulation module comprises multiple third heat exchangers 320. Each of the third heat exchangers 320 is located below the first circulation module 200, and comprises a heat exchange device 322 and a vapor propelling device 324. The heat exchange device 322 has a first end 322*a* and a second end 322*b*. The vapor propelling device 324 located at an outlet of the first end 322*a* is communicated between the first end 322*a* and the second heat exchanger 240, and the second heat exchanger 240 is connected to the second end 322*b*, so as to form a loop of a second working fluid R2 between each of the third heat exchangers 320 and the second heat exchanger 240. The second working fluid R2 is circulated between the second heat exchanger 240, the heat exchange device 322, and the vapor propelling device 324 through the loop. The second working fluid R2 is R-134a, R-12, R-22, or other types of refrigerants.

Figure 3:
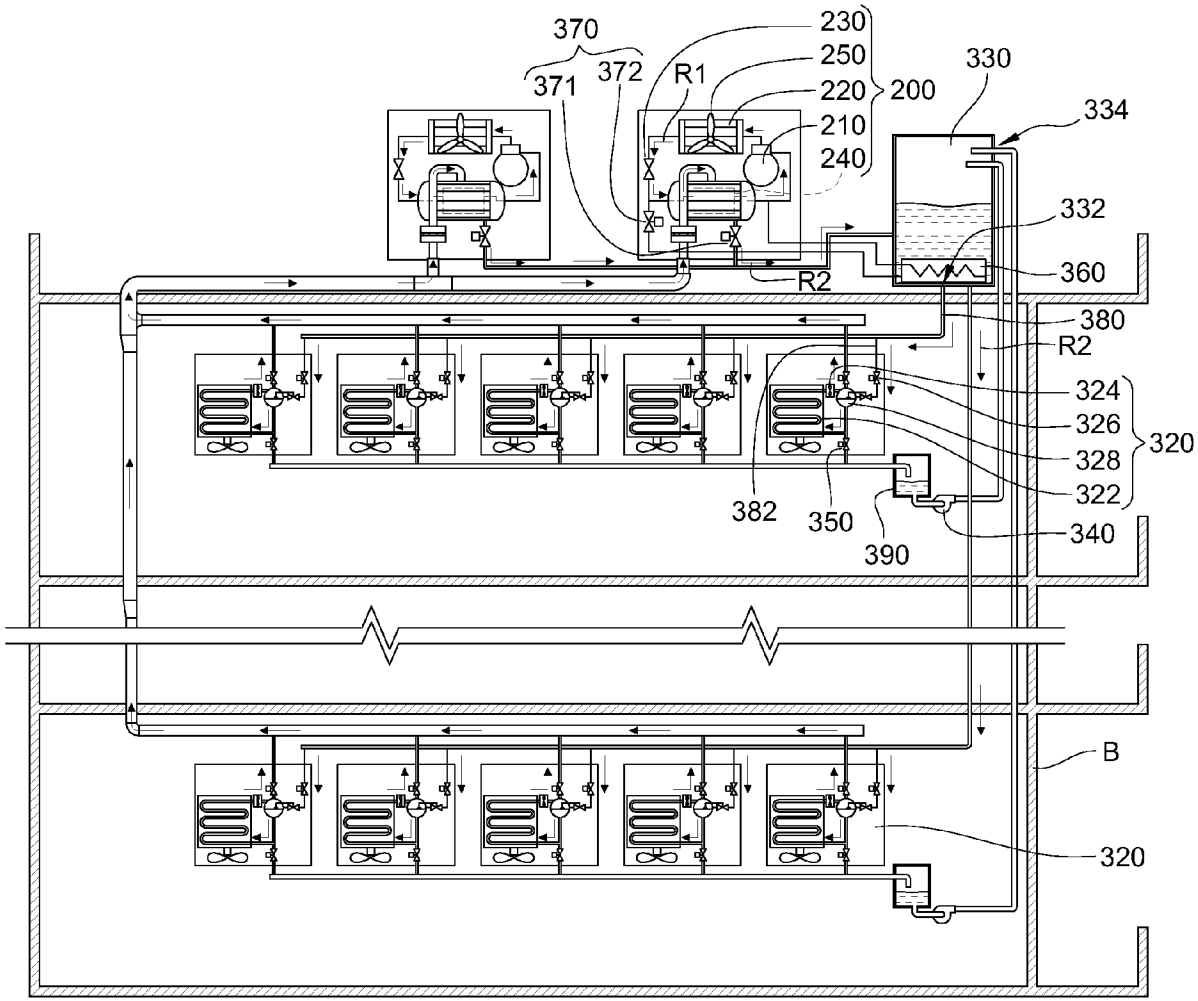
FIG. 3 is a schematic view of the air conditioning system in FIG. 1 in a cooling mode.

Based on the above structure, the air conditioning system 100 of this embodiment may perform refrigerating air conditioning on a space, so as to reduce the temperature of this space, i.e., the air conditioning system 100 is in a cooling mode. FIG. 3 is a schematic view of the air conditioning system 100 in a cooling mode. In this embodiment, the adjustment of the temperature of a space inside a building B is taken as an example for the convenience of illustration. In this embodiment, the first circulation module 200 and the second heat exchanger 240 are located on the roof of the building B, and the third heat exchangers 320 is located inside the building B. When the air conditioning system 100 is in the cooling mode, the first heat exchanger 220 functions as a condenser, and the second heat exchanger 240 functions as an evaporator.

Based on the above structure of the first circulation module 200, the first working fluid R1 in a low-pressure vapor state is compressed by the compressor 210 into a high-pressure vapor state. Then, the first working fluid R1 in the high-pressure vapor stat enters the first heat exchanger 220 and dissipates heat to the external environment, and is thus changed into a high-pressure liquid state. In this embodiment, the heat generated by the first working fluid R1 in the high-pressure liquid state is dissipated by a fan 250 to the ambient environment. Afterward, the first working fluid R1 in the high-pressure liquid state enters the expansion device 230 and is expanded into a saturated low-pressure state. The first working fluid R1 in the low-pressure liquid state enters the second heat exchanger 240 after flowing through the expansion device 230, so as to receive the heat of the second working fluid R2 (which will be described later) to become the first working fluid R1 in a low-pressure vapor state, which then returns to the compressor 210 to complete a circulation of the first working fluid R1.

It should be noted that, compared with the prior art, the compressor 210, the first heat exchanger 220, the expansion device 230, and the second heat exchanger 240 in the first circulation module 200 are all substantially located at the same height, such that the compressor 210 can provide sufficient kinetic energy for the first working fluid R1, so as to bring the lubricant carried out of the compressor 210 by the first working fluid R1 back to the compressor 210.

In this embodiment, the second heat exchanger 240 functions as a condenser for the second circulation module, and the third heat exchangers 320 function as an evaporator. Based on such configuration, the second working fluid R2 in a saturated vapor state performs heat exchange with the first working fluid R1 in the second heat exchanger 240 so as to transfer heat to the first working fluid R1, and is thus changed into a saturated liquid state. Afterward, as the second heat exchanger 240 is placed higher than the third heat exchangers 320, the second working fluid R2 in a saturated liquid state enters the heat exchange devices 322 of the third heat exchangers 320 under the effect of gravity, and absorbs the heat in the space of the building B to be changed into the saturated vapor state again. The second working fluid R2 in the saturated vapor state is then propelled by the vapor propelling device 324 back to the second heat exchanger 240, thus completing a circulation of the second working fluid R2.

It should be noted that, in the second circulation module, the vapor propelling device 324 is adapted to propel the second working fluid R2 in the saturated vapor state from the third heat exchangers 320 to the second heat exchanger 240, so the vapor propelling device 324 is a fan or a blower. Moreover, not provided with a compressor, the second circulation module does not have the problem in the prior art that the lubricant is carried in the second working fluid R2.

Next, referring to FIGS. 1, 2, and 3 together, in order to make the second working fluid R2 flow more smoothly, in this embodiment, the air conditioning system 100 further comprises a main liquid storage tank 330. The main liquid storage tank 330 is communicated between the second heat exchanger 240 and the second end 322*b* of each of the heat exchange devices 322, and an opening 332 of the main liquid storage tank 330 is communicated with the second end 322*b*. Therefore, in this embodiment, a part of the second working fluid R2 is accommodated in the main liquid storage tank 330. Preferably, the main liquid storage tank 330 is placed higher than the third heat exchangers 320, so that the second working fluid R2 in the main liquid storage tank 330 is distributed to each of the third heat exchangers 320 under the effect of gravity.

In addition, referring to FIGS. 1 and 2 again, in this embodiment, the air conditioning system 100 further comprises a pump 340 and a control device 350. The pump 340 is placed lower than the second end 322*b* of the heat exchange devices 322, and is communicated with the main liquid storage tank 330 via the opening 334 of the main liquid storage tank 330. The control device 350 is communicated between the main liquid storage tank 330, the second end 322*b*, and the pump 340. In this embodiment, the control device 350 is a valve placed at a height between the second end 322*b* and the pump 340. The control device 350 has a first status (closed status) and a second status (open status). In the first status, the control device 350 guides the second working fluid R2 into the second end 322*b*; in the second status, the control device 350 guides the second working fluid into the pump 340. Based on the above design, the air conditioning system 100 may not only operate in a cooling mode, but also in a heating mode to raise the temperature in the building B.

Figure 4:
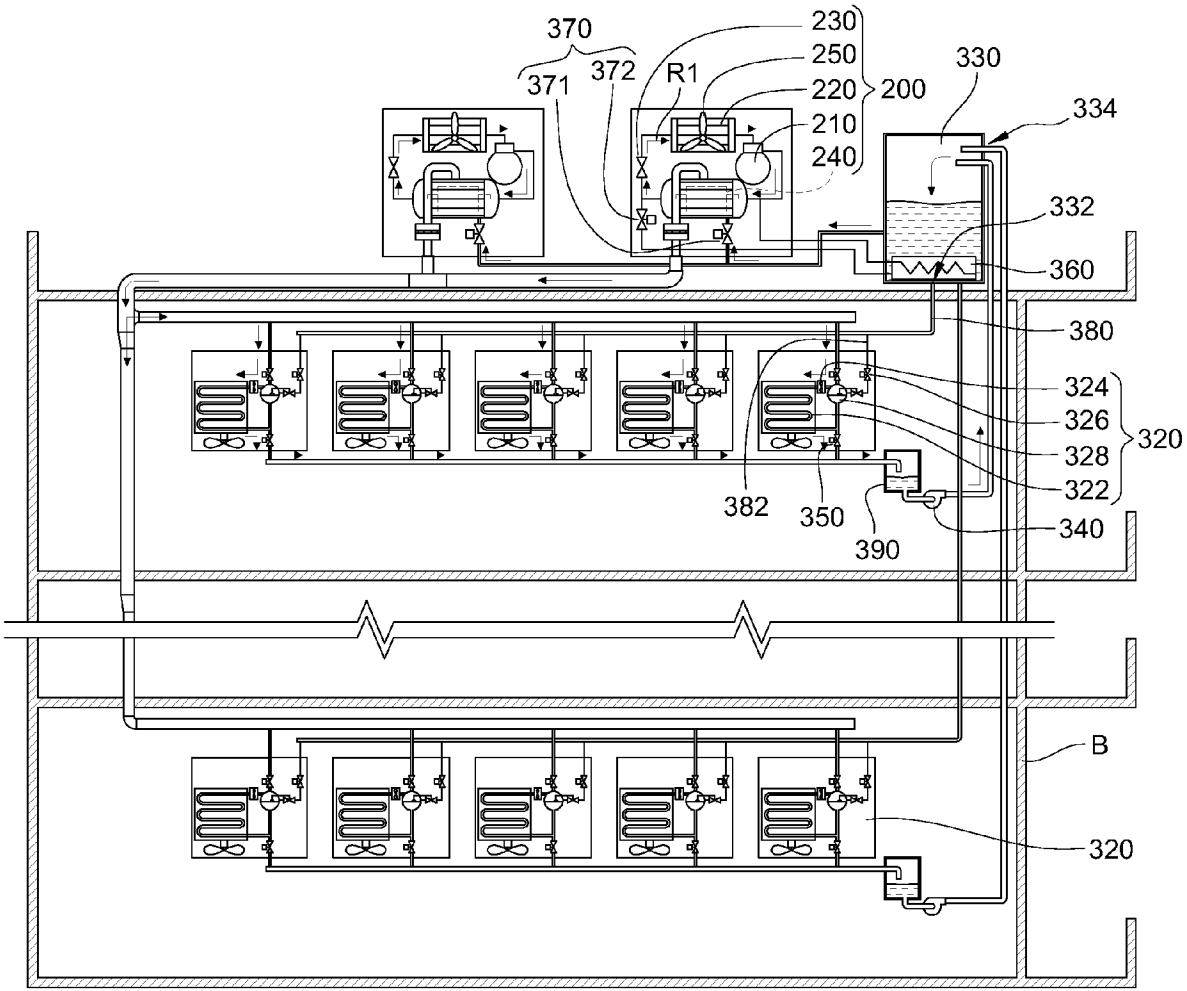
FIG. 4 is a schematic view of the air conditioning system in FIG. 1 in a heating mode.

Referring to FIGS. 1, 2, and 4 together, FIG. 4 is a schematic view of the air conditioning system 100 in a heating mode. When the air conditioning system 100 is in the heating mode, the first heat exchanger 220 functions as an evaporator, and the second heat exchanger 240 functions as a condenser. That is, the first working fluid R1 in a low-pressure vapor state is compressed by the compressor 210 into a high-pressure vapor state. Then, the first working fluid R1 in the high-pressure vapor state enters the second heat exchanger 240 and dissipates heat to the external environment, and is thus changed into a high-pressure liquid state. Afterward, the first working fluid R1 in the high-pressure liquid state enters the expansion device 230 and is expanded into a saturated low-pressure state. The first working fluid R1 in the high-pressure liquid state enters the first heat exchanger 220 after flowing through the expansion device 230, so as to receive the heat of the second working fluid R2 (which will be described later) to become the first working fluid R1 in a low-pressure vapor state, which then returns to the compressor 210 to complete a circulation of the first working fluid R1.

Moreover, when the air conditioning system 100 is in the heating mode, the control device 350 is in the second status, and the flow path between the opening 332 of the main liquid storage tank 330 and end portions of the third heat exchangers 320 is closed by a valve 326. The second heat exchanger 240 functions as an evaporator, and the third heat exchangers 320 function as a condenser. In particular, the second working fluid R2 in a saturated liquid state performs heat exchange with the first working fluid R1 in the second heat exchanger 240, and absorbs the heat of the first working fluid R1 to be changed into a saturated vapor state. Afterward, the second working fluid R2 in the saturated vapor state is propelled by the vapor propelling device 324 to enter the heat exchange devices 322 of the third heat exchangers 320 via the first end 322*a*, and dissipates heat into the space of the building B to be changed into the saturated liquid state again. Finally, the second working fluid R2 in the saturated liquid state is drawn by the pump 340 back to the second heat exchanger 240, thus completing a circulation of the second working fluid R2.

In addition, referring to FIGS. 1 and 2 again, in an embodiment of the invention, the air conditioning system 100 further comprises a fourth heat exchanger 360 and a control device module 370. The fourth heat exchanger 360 is located in the main liquid storage tank 330. The control device module 370 is communicated between the expansion device 230, the second heat exchanger 240, and the fourth heat exchanger 360. Specifically, in this embodiment, the control device module 370 comprises a valve 371 and a valve 372. The valve 371 is located in a flow path extending from the expansion device 230 to the main liquid storage tank 330 through the second heat exchanger 240. The valve 372 is located in another flow path extending from the expansion device 230 to the main liquid storage tank 330 without passing through the second heat exchanger 240.

The control device module 370 has a first status and a second status. When the control device module 370 is in the first status, the valve 371 is open and the valve 372 is closed, so the control device module 370 guides the second working fluid R2 into the second heat exchanger 240. When the control device module 370 is in the second status, the valve 371 is closed and the valve 372 is open, so the control device module 370 guides the first working fluid R1 into the fourth heat exchanger 360.

Figure 5:
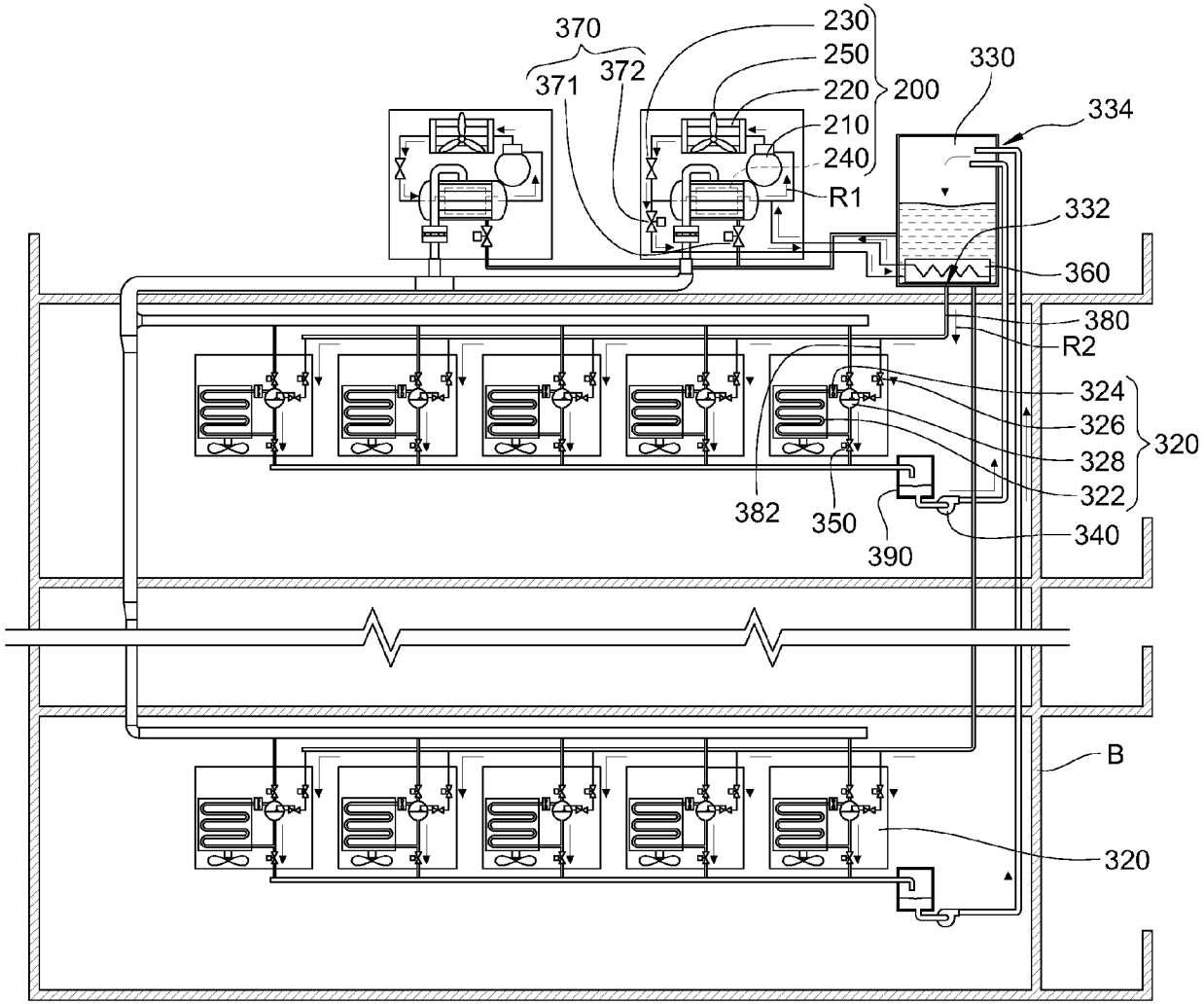
FIG. 5 is a schematic view of the air conditioning system in FIG. 1 in a pre-cooling mode.

Referring to FIGS. 1, 2, and 5 together, FIG. 5 is a schematic view of the air conditioning system 100 in a pre-cooling mode. Based on the above design, the air conditioning system 100 may not only operate in a cooling mode or a heating mode, but also in a pre-cooling mode before cooling. When the air conditioning system 100 operates in the pre-cooling mode, the fourth heat exchanger 360 functions as an evaporator, the first heat exchanger 220 functions as a condenser, the control device module 370 is in the second status, and the control device 350 is also in the second status. Thereby, the first circulation module 200 can reduce the temperature of the second working fluid R2 in the main liquid storage tank 330 by using the fourth heat exchanger 360. Further, when the fourth heat exchanger 360 reduces the temperature of the second working fluid R2 in the main liquid storage tank 330, as the control device module 350 is in the second status, the second working fluid R2 flowing from the opening 332 of the main liquid storage tank 330 is directly drawn back to the main liquid storage tank 330 by the pump 340, so as to complete a circulation of the second working fluid. It should be noted that, in this circulation, the second working fluid R2 does not flow into the heat exchange devices 322 through the second end 322*b* of the heat exchange devices 322. In the pre-cooling mode, as the second working fluid R2 does not enter the heat exchange devices 322, most of the second working fluid R2 in the second circulation module is drawn by the pump 340 into the main liquid storage tank 330, such that the air conditioning system 100 can reduce the temperature of most of the second working fluid R2 to a preset value within a short period of time. After the second working fluid R2 reaches the preset temperature, the control device module 370 and the control device 350 are both switched from the second status to the first status, such that the air conditioning system 100 is switched from the pre-cooling mode to the cooling mode to reduce the temperature inside the building B.

Further, in order to make the second working fluid R2 flow more smoothly, in an embodiment of the invention, the air conditioning system 100 further comprise a secondary liquid storage tank 390, which is communicated between the control device 350 and the pump 340, and is adapted to store a part of the second working fluid R2.

Moreover, referring to FIGS. 1 and 2 again, in the air conditioning system 100, in an embodiment of the invention, each of the third heat exchangers 320 further comprise a valve 326, such that the air conditioning system 100 can operate in a part load mode. The valves 326 are located between the main liquid storage tank 330 and the second end 322*b* of the heat exchange devices 322. Specifically, in the air conditioning system 100, a main working fluid conduit 380 and multiple secondary working fluid conduit 382*a* are disposed between the main liquid storage tank 330 and the third heat exchangers 320. One end of the main working fluid conduit 380 is communicated with the main liquid storage tank 330. One end of each of the secondary working fluid conduit 382 is communicated with the main working fluid conduit 380, and the other end is respectively communicated with the vapor propelling device 324 of each of the third heat exchangers 320. The valves 326 are located in the secondary working fluid conduit 382. When the air conditioning system 100 is in the part load mode, a part of the third heat exchangers 320 are in operation, while the others are shut down.

Figure 6:
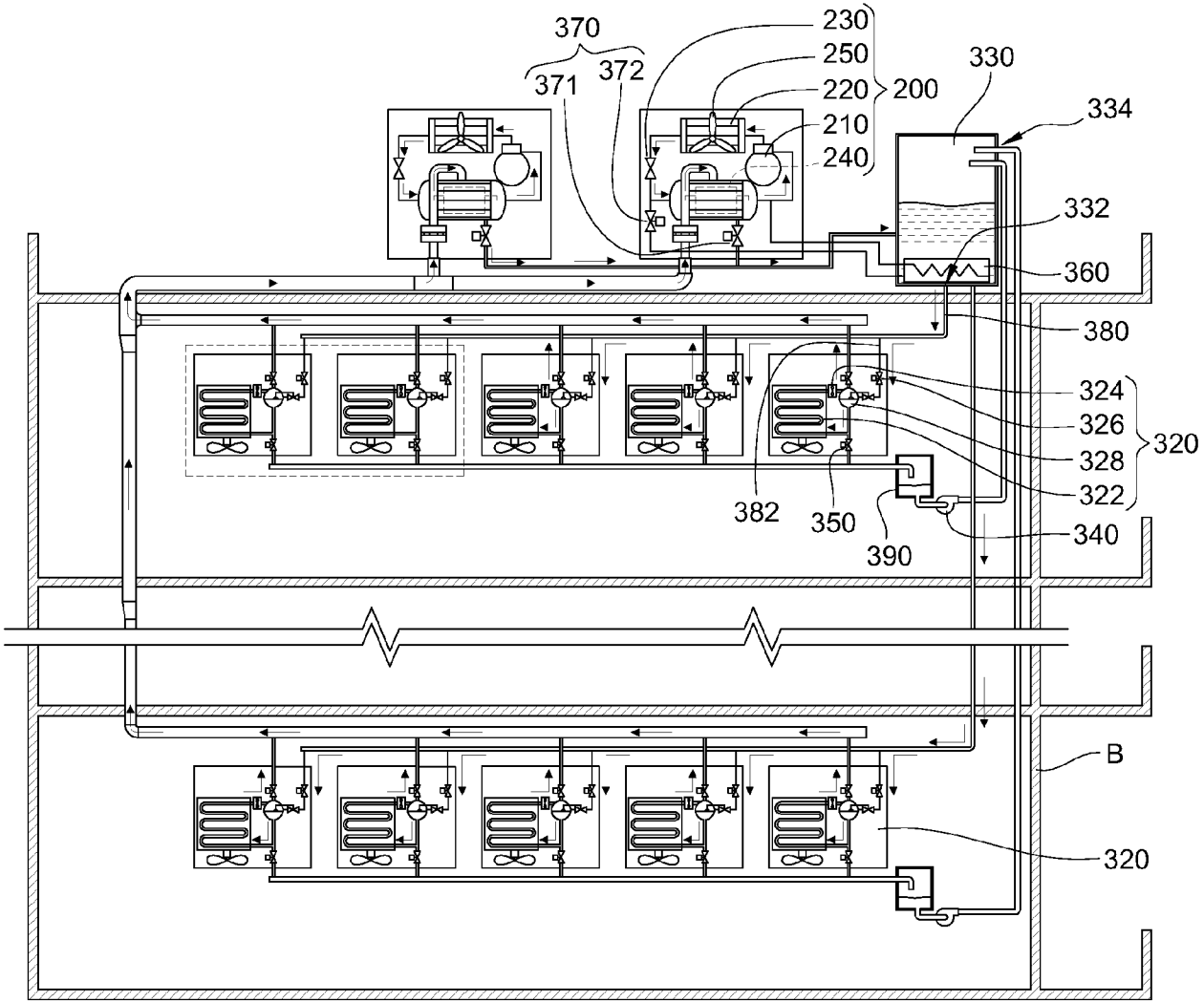
FIG. 6 is a schematic view of the air conditioning system in FIG. 1 in a part load mode.

Referring to FIGS. 1, 2, and 6 together, FIG. 6 is a schematic view of the air conditioning system 100 in a part load mode. In the part load mode, the air conditioning system 100 operates in a way similar to the cooling mode. However, different from the cooling mode, when the air conditioning system 100 is in the part load mode, the path for communicating the main liquid storage tank 330 with the third heat exchangers 320 in an OFF-status is cut off, i.e., the valves 326 of the third heat exchangers 320 in the OFF-status are closed, such that the second working fluid R2 is unable to enter the third heat exchangers 320 in the OFF-status (as shown by the two third heat exchangers 320 circled by a dashed line in FIG. 6) from the main liquid storage tank 330. Moreover, the path for communicating the main liquid storage tank 330 with the third heat exchangers 320 in an ON-status (as shown by the plurality of third heat exchangers 320 not circled by any dashed line in FIG. 6) is open, i.e., the valves 326 of the third heat exchangers 320 in the ON-status are open, such that the second working fluid R2 can enter the third heat exchangers 320 in the ON-status from the main liquid storage tank 330. In addition, the second working fluid R2 remaining in the third heat exchangers 320 in the OFF-status is drawn by the pump 340 into the main liquid storage tank 330.

Based on the above structure, in this embodiment, the third heat exchangers 320 at a specific position are turned on or off, or the number of the third heat exchangers 320 in the ON-status are adjusted according to air conditioning requirements, such that the air conditioning system 100 achieves a high utilization efficiency of the second working fluid R2 with a small amount of the second working fluid R2.

Moreover, in an embodiment of the invention, each of the third heat exchangers 320 further comprises a liquid-vapor separation tank 328. An upper side of the liquid-vapor separation tank 328 is communicated with the vapor propelling device 324 and the main liquid storage tank 330, and a lower side of the liquid-vapor separation tank 328 is communicated with the control device 350. Through the design of the liquid-vapor separation tanks 328, a part of the second working fluid R2 is accommodated in the liquid-vapor separation tanks 328, and the air conditioning system 100 detects the liquid level of the second working fluid R2 in the liquid-vapor separation tanks 328, for example, through a liquid level sensor (not shown). The air conditioning system 100 in the cooling mode determines the degree of opening the valves 326 by measuring the liquid level of the second working fluid R2 in the liquid-vapor separation tanks 328 of the third heat exchangers 320, so as to adjust the amount of the second working fluid R2 flowing into the third heat exchangers 320.

Figure 7:
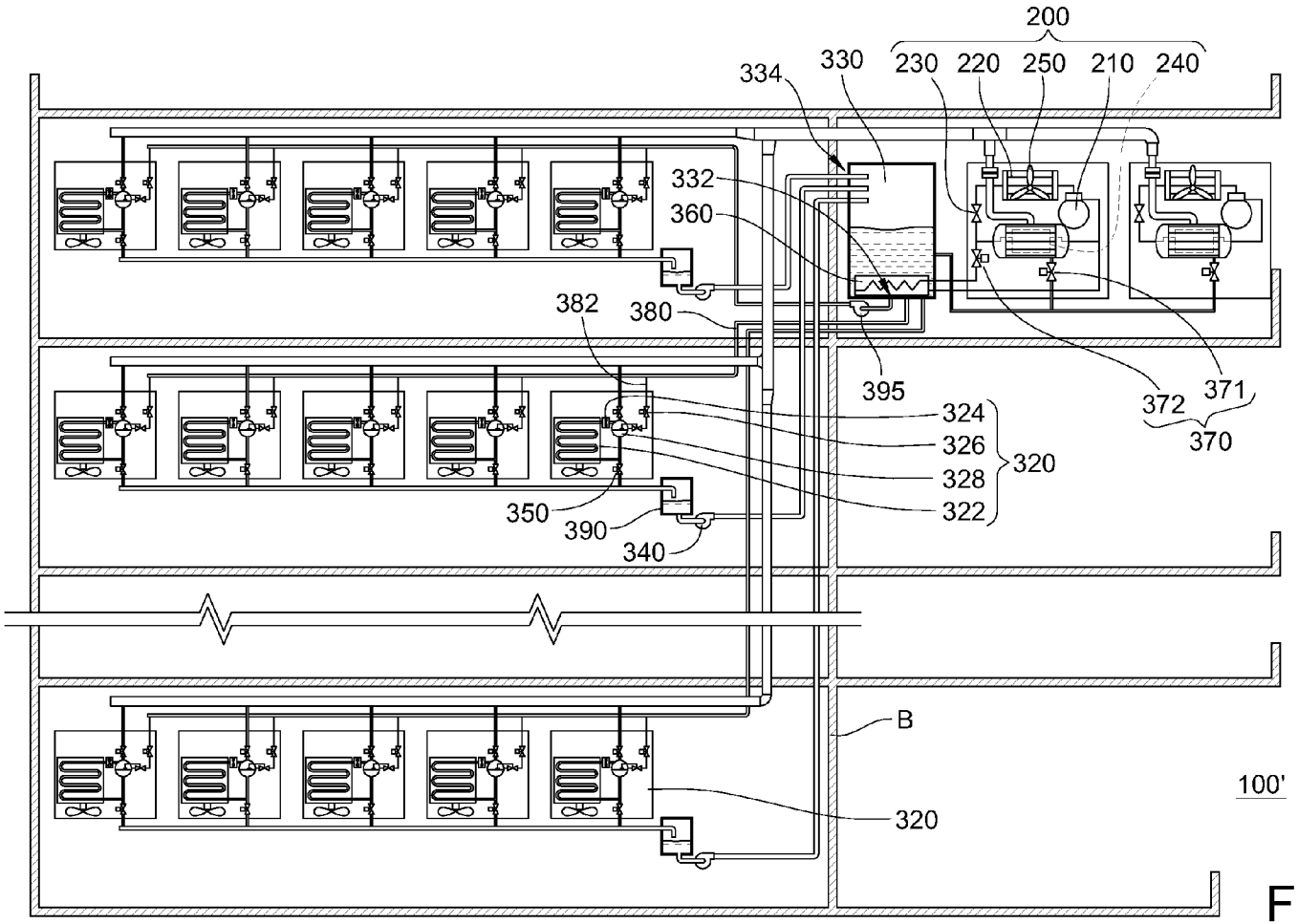
FIG. 7 is a schematic view of an air conditioning system according to another embodiment of the present invention.

In the above embodiment, it is not limited that the first circulation module 200 must be placed higher than the fourth heat exchangers. FIG. 7 is a schematic view of an air conditioning system according to another embodiment of the present invention, in which like reference numerals represent the same members in FIG. 1. Referring to FIG. 7, the air conditioning system 100' of this embodiment mainly differs from the air conditioning system 100 in FIG. 1 in that, the first circulation module 200 is not placed higher than the third heat exchangers 320. In order to make the second working fluid R2 in the main liquid storage tank 330 uniformly distributed to each of the third heat exchangers 320, the air conditioning system 100' further comprises a pump 395. The pump 395 is disposed between the main liquid storage tank 330 and the third heat exchangers 320, so that when the air conditioning system 100' is in the cooling, pre-cooling, or part load mode, the second working fluid R2 is uniformly distributed by the pump 395 to each of the third heat exchangers 320.

In view of the above, as the present invention uses the first circulation module and the second circulation module independent from each other, and the second circulation module does not have a compressor for compressing the working fluid from the liquid state into the vapor state, the problem that the lubricant is retained in the circulation conduit may not occur to the second circulation module. Therefore, compared with the prior art, in the present invention, the design of the second circulation conduit is not limited by the vertical height or horizontal length.

In addition, as the fourth heat exchangers of the present invention are located below the first circulation module, the liquid second working fluid may be uniformly distributed into each of the fourth heat exchangers under the effect of gravity.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An air conditioning system, comprising:

a first circulation module, having a first working fluid circulated therein, the first circulation module comprising:

a compressor, for compressing the first working fluid from a low-pressure vapor state into a high-pressure vapor state;

a first heat exchanger, connected to the compressor;

an expansion device, connected to the first heat exchanger; and a second heat exchanger, connected between the expansion device and the compressor;

a second circulation module, having a second working fluid circulated therein, the second circulation module comprising:

a plurality of third heat exchangers, each of the third heat exchangers comprising a heat exchange device and a vapor propelling device, wherein the heat exchange device has a first end and a second end, the vapor propelling device is in a fluid communication with the first end of the heat exchange device and the second heat exchanger, and the second end of the heat exchange device is connected to the second heat exchanger, to form a working fluid loop between the second heat exchanger and the third heat exchangers, and the vapor propelling device propels the second working fluid in a saturated vapor state to flow between the heat exchanger device and the second heat exchanger, wherein in the second heat exchanger a heat exchange is performed between the second working fluid and the first working fluid; and a main liquid storage tank, connected between the second heat exchanger and each second end of the third heat exchanges, and placed higher than the third heat exchangers.

2. The air conditioning system according to claim 1, further comprising:

a pump, placed lower than the second end of the heat exchange device, being in a fluid communication with the main liquid storage tank; and a control device, being in a fluid communication with the main liquid storage tank, the second end of the heat exchange device, and the pump, and having a first status and a second status, wherein in the first status, the control device guides the second working fluid into the second end, and in the second status, the control device guides the second working fluid into the pump.

3. The air conditioning system according to claim 2, wherein the first circulation module further comprises:

a fourth heat exchanger, located in the main liquid storage tank; and a control device module, being in a fluid communication with the expansion device, the second heat exchanger, and the fourth heat exchanger, and having a first status and a second status, wherein in the first status, the control device module guides the second working fluid into the second heat exchanger, and in the second status, the control device module guides the second working fluid into the fourth heat exchanger.

4. The air conditioning system according to claim 3, wherein the control device module comprises a first valve and a second valve, the first valve is located in a first flow path extending from the expansion device to the main liquid storage tank through the second heat exchanger, and the second valve is located in another flow path extending from the expansion device to the main liquid storage tank without passing through the second heat exchanger.

5. The air conditioning system according to claim 2, wherein each of the third heat exchangers further comprises a liquid-vapor separation tank, an upper side of the liquid-vapor separation tank is in a fluid communication with the vapor propelling device and the main liquid storage tank, and a lower side of the liquid-vapor separation tank is communicated with the control device.

6. The air conditioning system according to claim 5, further comprising a liquid level sensor located in the liquid-vapor separation tanks, for measuring a liquid level of the second working fluid in the liquid-vapor separation tanks.

7. The air conditioning system according to claim 2, wherein the control device is a valve placed at a height between the second end and the pump.

8. The air conditioning system according to claim 7, further comprising a secondary liquid storage tank being in a fluid communication with the valve and the pump.

9. The air conditioning system according to claim 2, wherein each of the third heat exchangers further comprises a valve being in a fluid communication with the main liquid storage tank and the heat exchange device.

10. The air conditioning system according to claim 1, wherein the vapor propelling device is a fan.

11. The air conditioning system according to claim 1, wherein the vapor propelling device is a blower.

12. The air conditioning system according to claim 1, wherein the third heat exchangers are located below the first circulation module.

13. The air conditioning system according to claim 1, further comprising a pump located between the main liquid storage tank and the third heat exchangers.

14. The air conditioning system according to claim 1, wherein the second circulation module does not have a compressor.

* * * * *